United States Patent [19]

Ruddock, administrator et al.

[11] Patent Number: 4,589,248

[45] Date of Patent: May 20, 1986

[54] HORSE TRAINING HALTER

[76] Inventors: by William U. Ruddock, administrator, P.O. Box 45, Hwy. 90A, Gonzales, Tex. 78629; Henry C. Weston, deceased, late of Gonzales, Tex.

[21] Appl. No.: 636,622

[22] Filed: Aug. 1, 1984

[51] Int. Cl.[4] ..... B68B 1/02

[52] U.S. Cl. ..... 54/24; 54/6 A

[58] Field of Search ..... 54/6 A, 6 R, 14, 15, 54/16, 24, 71

[56] References Cited

U.S. PATENT DOCUMENTS 1,333,474 3/1920 De France ..... 54/15
2,572,517 10/1951 Ratliff ..... 54/6 R
3,306,005 2/1967 Stafford ..... 54/24 X
4,343,136 8/1982 LeTixerant et al. ..... 54/16 X

*Primary Examiner*—Robert P. Swiatek
*Attorney, Agent, or Firm*—Cox & Smith, Inc.

[57] ABSTRACT

Apparatus for training and reducing the amount of effort required to control the movements of a horse. A cover is adjustably positioned on the horse's head by means of retaining straps. A cable movable longitudinally through the cover is provided at both ends with anchored pulleys to pull the cable through the cover. One end of the cable which runs through the pulley is anchored to the horse such that pulling the other end of the cable causes pressure to be exerted against the sensitive portion of the horse's nose, thereby forcing the horse's head downwardly.

8 Claims, 2 Drawing Figures

HORSE TRAINING HALTER

BACKGROUND OF THE INVENTION

This invention relates generally to an apparatus used to train horses by controlling up-and-down head movement and to guide horses by controlling or directing side-to-side head movement. In particular, the present invention relates to an apparatus comprised of positioning straps for the horse's head, controlling straps for the nose and an integral pulley-and-cable mechanism whereby the rider directs the movement of the horse's head.

Horse bridle and rein mechanisms are known in the art. Known halter patents include U.S. Pat. No. 2,457,246 issued to J. G. Lawrence, No. 2,804,741 issued to W. W. Cheesebro, No. 2,023,523 issued to Lee, No. 4,304,193 issued to L. A. Madden, No. 4,214,420 issued to K. B. Ferree, No. 1,552,145 issued to F. Haile, and No. 3,731,456 issued to R. S. Hill.

These devices suffer from a number of disadvantages and limitations including the necessity of using a bit in the horse's mouth and the fact that those bridles which are designed to control up-and-down movement have limited ability to control side-to-side movement of the horse's head. Training a horse to obey commands using such an apparatus is often a difficult process. Traditionally, training halters have bits, which, during the rigors of the training, may permanently harm the horse's mouth. Bitless halters do exist, but they do not solve the second training problem, that of controlling the young or untamed horse during the initial training. A need exists for an apparatus for controlling the untamed horse that is simple to manufacture and simple to use, does not use a bit, and has a mechanism that lessens the amount of effort which must be exerted by the rider to control the horse during training. The apparatus must also permit directional control of the horse in the normal manner to facilitate control of the horse after it has been trained.

It is, therefore, an object of the present invention to provide an apparatus for the directional control of a horse comprising positioning straps for the horse's head, controlling straps for the nose, and an integral pulley and cable mechanism whereby the rider directs the movement of the horse's head.

Another object of the present invention is to provide an apparatus for the training of an untamed horse which is both simple to manufacture and simple to use.

Another object of the present invention is to provide an apparatus for the training of an untamed horse which does not require the use of a bit.

Another object of the present invention is to provide an apparatus for the training of an untamed horse which will assert downward force on the horse's head when the reins are pulled upwardly by the rider.

An advantage of the present invention is that the rider is able to control the direction taken by the horse and the horse's tendency to raise its head by exerting less effort than that which must be exerted using conventional bridles. Another advantage of the present invention is that the direction taken by the horse is controlled in the same manner in which it is controlled by more traditional guiding means.

SUMMARY OF THE INVENTION

A horse-training apparatus comprising a cable and cover, the cable being movable within the cover. The cover is held in proper position on the horse's nose by positioning straps. Each end of the cable is attached to a means for pulling the cable through the cover such that the horse's head is forced towards the ground when the cable pulling means is pulled by the horse's rider. The cable pulling means is anchored to the horse. The rider can prevent the horse from raising his head by pulling on both cable pulling means at the same time or cause the horse to turn by pulling on one of the cable pulling means.

DESCRIPTION OF THE PREFERRED EMBODIMENT

Figure 1:
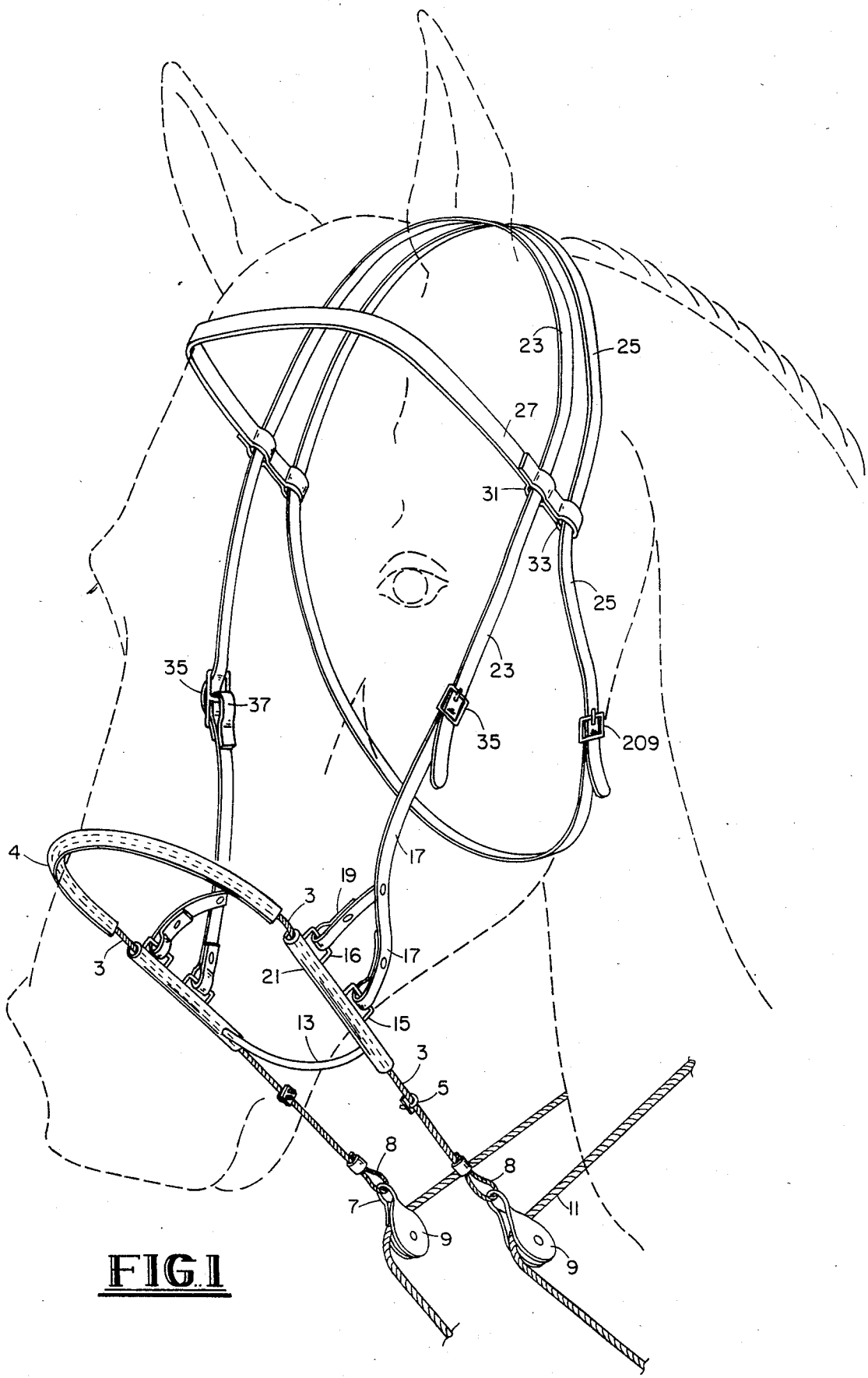
FIG. 1 is a perspective view of the training halter apparatus.

Referring to FIG. 1, the training apparatus includes jaw strap 25 which passes behind the ears and under and around the horse's jaw and is adjustable by means of a buckle 209. Poll strap 27 passes in front of the horse's ears and across the forehead and slides on straps 23 and 25 for adjustability by means of the loops 31 and 33 through which straps 23 and 25 pass respectively. Strap 23 passes behind the horse's ears and through loop 31 in poll strap 27 and is adjustable by means of buckles 35. Strap 17 attaches to strap 23 by means of loops 37 which connect to buckles 35 and, thus, to strap 23 by means of the ordinary buckling mechanisms. Strap 19 is attached to strap 17 by a permanently fixed connection. All straps 17, 19, 23, 25 and 27 are comprised of a flexible material such as leather or a like substance.

Straps 17 and 19 attach to loops 15 and 16 respectively, which are permanently affixed to the respective side cable covers 21. The side cable covers 21 are positioned in the sensitive region of the horse's nose by means of adjusting straps 23 and 17 and buckle 35. The side cable covers 21 are made of a comfortable, but somewhat rigid, material and provide a means for attachment of positioning straps 17 and 23 while preventing the cable 3 from injuring the horse. Cable 3 is made of flexible woven steel cable or similar material and passes through side cable covers 21 and top cable cover 4 and connects on both its ends to pulleys 9 by means of the pulley loop 7 and cable loop 8. In an alternative embodiment, each pulley 9 may be replaced by an O-ring passing through each loop 8. Top cable cover 4 is made of a rigid leather or similar material to allow bending across the bridge of the horse's nose, and is shaped so that when pressure is applied by means of cable 3 in the manner to be described such that top cable cover 4 is pulled tighter against the insensitive area of the horse's bridge, the top cable cover 4 concentrates the force applied without injuring the horse. Chin bar 13 connects the side cable 21 covers and aids in positioning the apparatus around the horse's nose. Cable stops 5 prevent the pulleys 9 from being pulled too far in any one direction by stopping the movement of the cable upon contact with the side cable covers 21. Cable stops 5 are adjustable by positioning at different points on cable 3.

Figure 2:
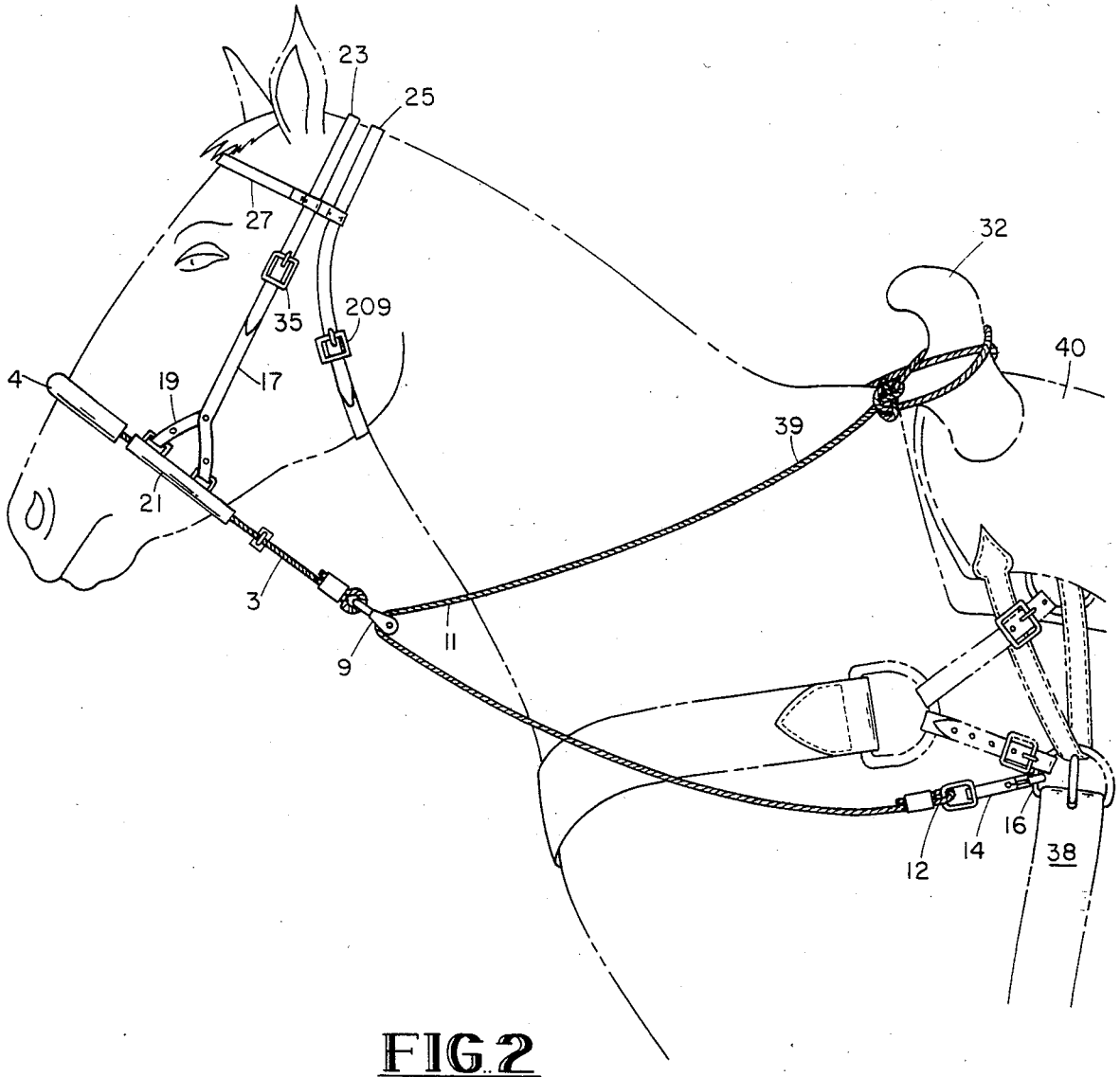
FIG. 2 is a side view of a horse wearing the apparatus of the present invention.

Referring to FIG. 2, rope 11 passes through pulley 9 and is connected to swivel clip 14 by means of loop 12 in rope 11. Swivel clip 14 is then clipped to the rigging 38 of saddle 40 at belly strap buckle 16 or other suitable point in the lower portion of the saddle. The other end 39 of rope 11 is shown looped around saddle pommel 32 but it is understood that it would be held by a rider during use of the present invention.

In order to use the training halter of the present invention, the straps 23, 25 and 27 are adjusted to fit the horse's head by means of buckles 35 and 209 so that top cable cover 4 bridges the top of the horse's nose and the side cable covers 21 are positioned in the sensitive portion of the horse's nose. Rope 11 is fastened, by means of swivel clip 14, to the saddle 40, preferably in the lower portion of the saddle rigging 38, for instance, at belly strap buckle 16. The end 39 of rope 11 is then passed through pulley 9 and up to the rider.

To cause the horse to turn to the right, the rider pulls backwardly and upwardly on the end 39 of right-hand rope 11, causing the pulley 9 on the right-hand side of the horse to be pulled downwardly such that cable 3 slides through top cable cover 4 until the cable stop 5 on the left-hand side of cable 3 contacts the side cable cover 21 on the left-hand side of the horse. As cable 3 begins to move through top cable cover 4 and side cable covers 21, force is exerted downwardly and to the right and pressure is exerted against the sensitive portion of the horse's nose, causing the horse to tend to move its head downwardly and to the right, thereby initiating a turn to the right.

If the horse should abruptly raise its head, or if the rider desires to check the horse's forward motion, the rider need only pull backwardly and upwardly on the end 39 of both ropes 11 at the same time. This pulling will result in force being applied in a downwards directon to pulleys 9, which is transmitted by means of cable 3, to the top cable cover 4 and to the sensitive portion of the horse's nose. This downward pressure will force the horse's head downwardly.

Although the invention has been described in conjunction with the foregoing specific embodiment, many alternatives, variations, and modifications will be apparent to those of ordinary skill in the art. Those alternatives and modifications are intended to fall within the spirit and scope of the appended claims.

I claim:

1. An apparatus for training and reducing the effort required to control the movement of a horse comprising:

a cable and cover, said cable being movable within said cover;

means passing over the horse's head for retaining said cable on the nose of the horse; said cable retaining means including a cover means slidably mounted on said cable said cable being slidably connected to a means for pulling said cable through both said said cover and said cover means such that the head of said horse is forced towards the ground when said cable pulling means is pulled by the rider of said horse; and means for anchoring said cable pulling means to said horse.

2. The apparatus of claim 1 wherein said cable is slidably connected to said head pulling means by a pulley.

3. The apparatus of calim 1 wherein said cable is slidably connected to said head pulling means by an O-ring.

4. The apparatus of claim 1 wherein said cable retaining means includes a strap passing over said horse's head which is connected to said cover means.

5. The apparatus of claim 1 wherein said cover comprises a tubular member of sufficient inner diameter to allow said cable to slide therethrough.

6. The apparatus of claim 1 wherein said cable pulling means comprises a rope.

7. The apparatus of claim 1 wherein said anchoring means comprises a clip connectible to the rigging of said saddle.

8. An apparatus for training and reducing the effort required to control the movement of a horse without a bit comprising:

a cable positioned across the top of the nose of a horse and down the sides of the nose;

a tubular member covering said cable adjacent said horse's nose;

a plurality of straps operable to position said tubular member in proper position on the horse's nose so that tensing the cable applies pressure through said tubular member on the sensitive portion of said horse's nose, one of said straps passing behind the ears of said horse and around the jaw of said horse, and one of said straps passing in front of the horse's ears said straps having cover means attached thereto to slidably engage said cable;

each of the ends of said being provided with a pulley; and a rope passing through each of said pulleys, one end of said rope being connectible in the rigging of a saddle on said horse, the other end of said rope being operable to pull said horse's head downwardly when the rider pulls one or both of said ropes.

* * * * *